US010538907B2

(12) United States Patent
Dooley et al.

(10) Patent No.: US 10,538,907 B2
(45) Date of Patent: Jan. 21, 2020

(54) MODULAR ASSEMBLIES AND METHODS OF CONSTRUCTION THEREOF

(71) Applicant: SkyStone Group LLC, New York, NY (US)

(72) Inventors: Jack Dooley, New York, NY (US); Scott Hill, New York, NY (US); Mike Lynch, New York, NY (US)

(73) Assignee: SKYSTONE GROUP LLC, New York, NY (US)

( * ) Notice: Subject to any disclaimer, the term of this patent is extended or adjusted under 35 U.S.C. 154(b) by 0 days.

(21) Appl. No.: 15/814,583

(22) Filed: Nov. 16, 2017

(65) Prior Publication Data

US 2019/0040619 A1 Feb. 7, 2019

Related U.S. Application Data

(60) Provisional application No. 62/539,661, filed on Aug. 1, 2017.

(51) Int. Cl.

| | |
|---|---|
| ***E04B 1/20*** | (2006.01) |
| ***E04B 1/348*** | (2006.01) |
| ***E04B 2/86*** | (2006.01) |
| *E04C 5/06* | (2006.01) |

(52) U.S. Cl.

CPC ..... *E04B 1/20* (2013.01); *E04B 1/3483* (2013.01); *E04B 2/86* (2013.01); *E04B 2/8635* (2013.01); *E04B 2002/8682* (2013.01); *E04C 5/06* (2013.01); *E04C 5/0609* (2013.01); *E04C 5/0645* (2013.01)

(58) Field of Classification Search

CPC ..... E04B 1/20; E04B 1/3483; E04B 1/34807; E04B 2/86; E04B 2/8635; E04B 2002/8682; E04C 5/06

USPC ..... 52/432, 334, 742.14

See application file for complete search history.

(56) References Cited

U.S. PATENT DOCUMENTS

| | | | | |
|---|---|---|---|---|
| 737,670 A * | 9/1903 | Simpson et al. | ..... | E04B 1/0007 52/293.2 |
| 813,439 A * | 2/1906 | Landon | ..... | B28B 7/168 249/144 |
| 1,031,048 A * | 7/1912 | Conzelman | ..... | E04B 1/185 52/283 |

(Continued)

FOREIGN PATENT DOCUMENTS

| | | | |
|---|---|---|---|
| CN | 206052962 | U | 3/2017 |
| JP | 2002245114 | A | 8/2002 |
| WO | 2005114495 | A1 | 12/2005 |

OTHER PUBLICATIONS

Patrick Sisson, "Massive Modular Dorm Build Like 'Scaled-up Lego Bricks'". Jun. 14, 2017; (https://www.curbed.com/2017/6/14/15800350/london-modular-dorm-prefab) 2 pages.

*Primary Examiner* — Patrick J Maestri
*Assistant Examiner* — Joseph J. Sadlon
(74) *Attorney, Agent, or Firm* — Carter, DeLuca & Farrell, LLP

(57) ABSTRACT

A modular assembly for forming a shear wall includes a modular frame having a first side, and formwork. The formwork has a reinforcing bar cage and a first wall each coupled to the first side of the modular frame. The first wall is disposed between the reinforcing bar cage and the first side of the modular frame.

18 Claims, 3 Drawing Sheets

(56) References Cited

U.S. PATENT DOCUMENTS 1,380,324 A * 5/1921 Piggins ..... E04B 1/215 52/236.7
1,491,205 A * 4/1924 Ford ..... E04G 9/10 249/16
1,526,776 A * 2/1925 Dalidz ..... E04G 11/10 249/15
1,537,278 A * 5/1925 Wilson ..... E04G 11/22 249/13
1,950,343 A * 3/1934 White ..... E04C 5/0609 52/649.3
2,017,832 A 10/1935 Hovey
2,498,403 A * 2/1950 Elmendorf ..... E04B 2/707 52/745.09
2,940,295 A * 6/1960 Post ..... E04C 2/382 52/204.1
3,564,795 A 2/1971 Henton
3,600,862 A * 8/1971 Eckert ..... E04B 1/00 52/236.9
3,645,056 A * 2/1972 Gerola ..... E04B 1/043 52/259
3,728,838 A * 4/1973 Stout ..... E04B 1/161 52/745.02
3,803,788 A * 4/1974 Artmann ..... C04B 20/0076 52/417
3,942,294 A * 3/1976 Savell, Jr. ..... E04B 1/04 52/259
4,017,051 A * 4/1977 Scott ..... E04G 13/04 249/115
4,081,935 A * 4/1978 Wise ..... E04B 1/21 52/236.8
4,107,886 A * 8/1978 Ray ..... E04B 1/162 52/431
4,202,145 A * 5/1980 Coulter ..... E04B 2/86 249/3
4,226,061 A * 10/1980 Day, Jr. ..... E04B 2/8652 52/125.2
4,299,065 A * 11/1981 Fairgrieve ..... E04B 1/3483 52/79.11
4,320,606 A * 3/1982 GangaRao ..... E04C 2/521 52/125.5
4,330,970 A * 5/1982 Bonink ..... E04B 1/215 52/125.4
4,441,286 A * 4/1984 Skvaril ..... E04B 1/34815 52/234
4,505,087 A * 3/1985 Sarda ..... E04B 5/43 264/31
4,532,745 A * 8/1985 Kinard ..... E04B 2/8629 52/251
4,616,459 A * 10/1986 Shubow ..... E04B 1/163 52/236.8
4,616,464 A * 10/1986 Schleich ..... E04C 3/293 52/260
4,783,940 A * 11/1988 Sato ..... E04B 1/2403 264/228
5,012,622 A * 5/1991 Sato ..... E02D 5/30 52/263
5,048,257 A * 9/1991 Luedtke ..... E04B 1/16 52/364
5,161,340 A * 11/1992 Wetton ..... E04B 1/21 52/236.7
5,205,091 A 4/1993 Brown
5,493,833 A * 2/1996 Irimies ..... B21K 1/463 219/98
5,548,939 A * 8/1996 Carmical ..... E04B 1/4135 52/698
5,682,717 A * 11/1997 Carranza-Aubry ..... E04B 1/215 52/251
5,809,713 A * 9/1998 Ray ..... E04H 12/04 52/223.7
5,861,105 A * 1/1999 Martineau ..... E04B 2/8652 249/190
5,881,519 A * 3/1999 Newkirk ..... B28B 7/0064 52/262
5,893,245 A 4/1999 Sekiguchi et al.
5,964,070 A * 10/1999 Redl ..... B44C 5/04 40/572
6,044,614 A * 4/2000 Bryant ..... E04G 11/08 249/34
6,119,425 A * 9/2000 Shimonohara ..... E04B 1/21 264/267
6,151,856 A * 11/2000 Shimonohara ..... E04B 2/8635 52/309.12
6,360,505 B1 * 3/2002 Johns ..... E04F 13/147 249/15
7,043,884 B2 5/2006 Moreno
7,096,629 B1 8/2006 Cox
7,171,787 B2 * 2/2007 Thomason ..... E04H 4/0087 52/169.7
7,832,174 B2 * 11/2010 Way ..... E04B 1/163 52/236.6
7,841,147 B2 11/2010 Moran
7,934,693 B2 * 5/2011 Bravinski ..... E04B 2/8647 249/216
8,056,299 B2 * 11/2011 Liskey ..... E02D 27/12 405/233
8,186,128 B2 * 5/2012 Way ..... E02D 27/02 52/236.6
8,209,925 B2 * 7/2012 Foley ..... E04B 1/2403 403/403
8,359,808 B2 * 1/2013 Stephens, Jr. ..... E04B 1/165 52/220.2
8,365,484 B2 * 2/2013 Foley ..... E04B 1/4114 403/403
8,365,498 B2 * 2/2013 Hurlburt ..... B32B 3/12 428/703
8,417,488 B2 4/2013 Klipfel, III
8,499,527 B2 * 8/2013 Kobayashi ..... E04B 1/3483 52/220.2
8,555,583 B2 * 10/2013 Ciuperca ..... B23P 11/00 52/309.11
8,756,890 B2 * 6/2014 Ciuperca ..... E04B 1/21 52/426
8,844,223 B2 * 9/2014 Zhong ..... E04B 1/161 52/259
8,919,062 B1 12/2014 Viness et al.
9,016,025 B2 * 4/2015 Jin ..... E04G 11/28 52/651.1
9,140,018 B2 9/2015 Southwell
9,267,287 B1 * 2/2016 Bongiorno ..... B66C 1/62
9,518,401 B2 12/2016 Wang
9,606,701 B1 3/2017 Jacobs, II et al.
9,631,363 B2 * 4/2017 Lee ..... E04B 2/8635
9,856,639 B2 * 1/2018 Koszo ..... E04B 1/165
10,196,818 B1 * 2/2019 Martell ..... E04C 3/07
2004/0074173 A1 4/2004 Miller
2006/0196132 A1 9/2006 Ruano
2011/0030288 A1 2/2011 Traulsen et al.
2011/0041435 A1 2/2011 Tragant Ruano et al.
2012/0304563 A1 12/2012 Hou et al.
2013/0305629 A1 11/2013 Stephenson et al.
2013/0318898 A1 * 12/2013 Way ..... E04B 2/8635 52/236.3
2014/0013683 A1 * 1/2014 Yin ..... E04B 5/16 52/223.6
2015/0104578 A1 4/2015 Spires
2015/0234377 A1 8/2015 Mizikovsky
2018/0112389 A1 * 4/2018 Lake ..... E04B 1/16

* cited by examiner

MODULAR ASSEMBLIES AND METHODS OF CONSTRUCTION THEREOF

CROSS-REFERENCE TO RELATED APPLICATION

This application claims the benefit of and priority to U.S. Provisional Application No. 62/539,661, filed on Aug. 1, 2017, the entire contents of which are incorporated by reference herein.

BACKGROUND

Technical Field

The present disclosure relates generally to modular buildings. More particularly, the present disclosure relates to shear walls of modular buildings and methods of fabricating shear walls.

Background of Related Art

Modular units are commonly used for constructing commercial, residential, medical, and industrial structures because they can be partially assembled/constructed remote from the building site and transported to the building site for assembly into a complete building structure. One method of constructing modular buildings utilizes a concrete shear core that functions as a primary structural element for the building. A concrete shear core is generally a large, hollow, vertical column of reinforced concrete, located generally at an interior of the building. The concrete shear core provides a sturdy central structural member that, cooperatively with peripheral columns and transverse beams, reacts to the static and dynamic loads imposed by and on the building. The concrete shear core often houses many of the building services, such as the elevators, utilities, and the like.

Some buildings include supplemental shear walls that are independent of the concrete shear core and assist the concrete shear core in transferring lateral loads. Typically, during construction of supplemental shear walls, the shear walls can only be cast in one to two floor increments due to their slenderness. After the concrete of the first and/or second floors of the supplemental shear walls cures, formwork is removed and then the modular units may be attached.

Accordingly, one drawback to the above-identified method of construction is that continuous installation of modular units is prevented, thereby lengthening the duration of modular unit installation.

SUMMARY

In one aspect of the present disclosure, a modular assembly for forming a shear wall is provided and includes a modular frame and formwork. The formwork includes a first wall coupled to the first side of the modular frame.

In embodiments, the modular assembly may further include a reinforcing bar cage coupled to the modular frame. The first wall may be disposed between the reinforcing bar cage and the first side of the modular frame.

In embodiments, the modular assembly may further include a connector interconnecting the modular frame and the formwork. The connector may be a fastener that extends laterally from the first side of the modular frame, through the first wall of the formwork, and into a cavity of the formwork.

The fastener may include a first end welded to the modular frame, and a second end welded to the reinforcing bar cage.

In embodiments, the formwork may further include a second wall spaced from the first wall, such that the formwork defines a cavity between the first and second walls. The reinforcing bar cage may be disposed within the cavity.

In embodiments, the first wall may be fixedly coupled to the modular frame, and the second wall may be detachably coupled to the first wall.

In embodiments, the formwork may further include a reinforcing bar extending vertically within the cavity. The reinforcing bar may have an end configured to be coupled to an end of another reinforcing bar of another modular assembly.

In embodiments, the modular frame may include a plurality of shafts extending laterally from the first side of the modular frame. The second wall may be configured to be coupled to an end of each of the shafts. The shafts may extend horizontally through the cavity.

In another aspect of the present disclosure, a method of fabricating a modular assembly is provided and includes providing a prefabricated modular frame; fixedly coupling a first wall of formwork to a first side of the modular frame; and coupling a reinforcing bar cage of the formwork to the first side of the modular frame, such that the first wall is disposed between the reinforcing bar cage and the modular frame.

Some methods may further include fixing a first end of a connector to the first side of the modular frame, and fixing a second end of the connector to the reinforcing bar cage.

Some methods may further include coupling a second wall of the formwork to the first wall. The reinforcing bar cage may be disposed within a cavity defined between the first and second walls.

Some methods may further include positioning a reinforcing bar vertically within the cavity. The reinforcing bar may have an end configured to be coupled to an end of another reinforcing bar of another modular assembly.

Some methods may further include detachably connecting the second wall to an end of each of a plurality of shafts extending laterally from the first side of the modular frame.

In yet another aspect of the present disclosure, a method of constructing a shear wall of a modular building is provided and includes providing first and second prefabricated modular assemblies; stacking the first and second modular assemblies; and pouring concrete within the formwork of each of the first and second modular assemblies to form a shear wall that extends a stacked vertical height of the first and second modular assemblies.

Further details, advantages, and aspects of exemplary embodiments of the present disclosure are described in more detail below with reference to the appended figures.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

As used herein, the term "coupled" means either a direct mechanical connection between the components that are connected, or an indirect mechanical connection through one or more intermediary components.

BRIEF DESCRIPTION OF THE DRAWINGS

Embodiments of the present disclosure are described herein with reference to the accompanying drawings, wherein.

DETAILED DESCRIPTION

Figure 1A:
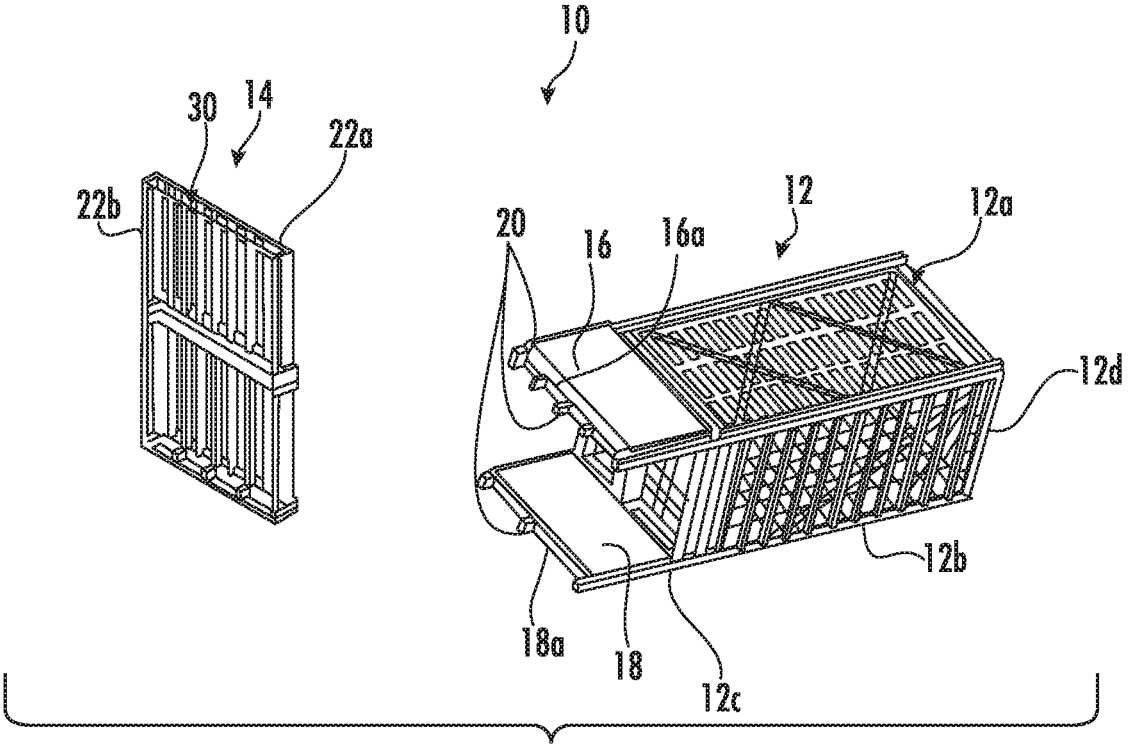
FIG. 1A is a perspective view of an embodiment of a modular assembly including a modular frame and formwork shown disassembled from one another.

Embodiments of the presently disclosed modular assemblies and methods of construction are described in detail with reference to the drawings, in which like reference numerals designate identical or corresponding elements in each of the several views.

The present disclosure provides a modular assembly that comes prefabricated with formwork attached to a frame thereof. The formwork is fixed to a side of the frame of the modular assembly and is used to create a shear wall of a modular building. The prefabricated modular assemblies may be delivered to a construction site having the formwork fixed thereto. At the construction site, the modular assemblies are stacked on top of one another to align the formwork of each to form one continuous, vertically extending formwork. Concrete is poured into the formwork and allowed to cure. After curing, an outer wall of the formwork is removed and an inner wall and a reinforcing bar of the formwork are left in place. The concrete, inner wall, and reinforcing bar act as the shear wall of the modular building. These and other features of the disclosed modular assemblies and their construction will be described in further detail herein.

Figure 1B:
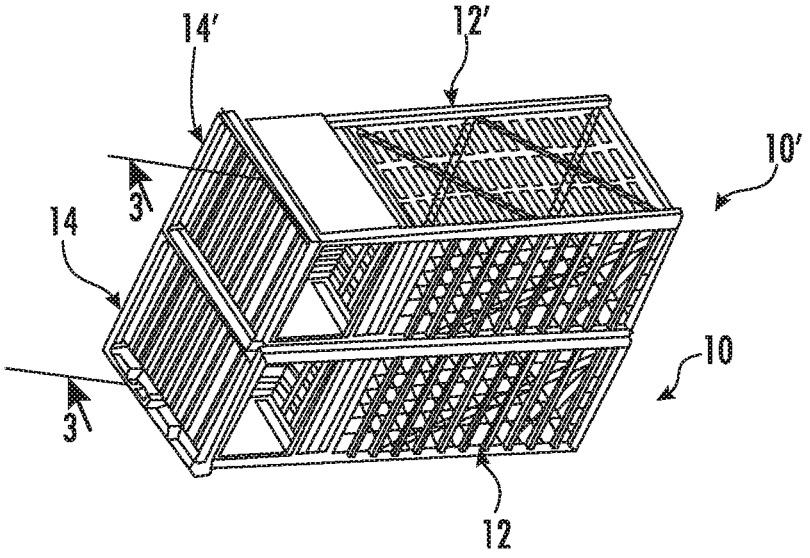
FIG. 1B is a perspective view of two of the modular assembly shown in FIG. 1A stacked on top of one another.

Referring initially to FIGS. 1A and 1B, illustrated is a modular assembly generally designated by reference numeral 10. The modular assembly 10 includes a metal frame 12 of a habitable modular unit and formwork 14 configured to form a shear wall of a modular building. The modular frame 12 is fabricated substantially from metal (e.g., steel) and has a generally rectangular shape. It is contemplated that the modular frame 12 may assume any suitable shape and may be fabricated from any suitable material.

The modular frame 12 includes upper and bottom surfaces 12*a*, 12*b* and first and second sides 12*c*, 12*d*. The upper and bottom surfaces 12*a*, 12*b* each have ceiling and floor platforms 16, 18, respectively, that extend laterally from the first side 12*c* of the frame 12. The platforms 16, 18 may extend from a short side of the modular frame 12, as shown in FIG. 1A.

Figure 2B:
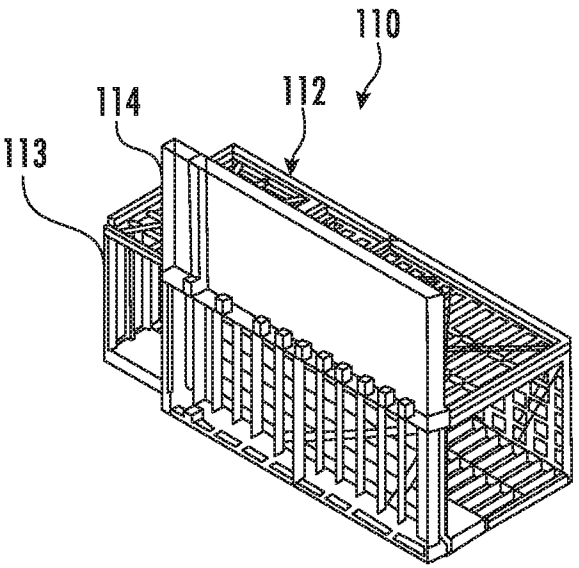
FIG. 2B is a perspective view of the modular assembly of FIG. 2A, illustrating the formwork and the modular frame in an assembled state.
Figure 2A:
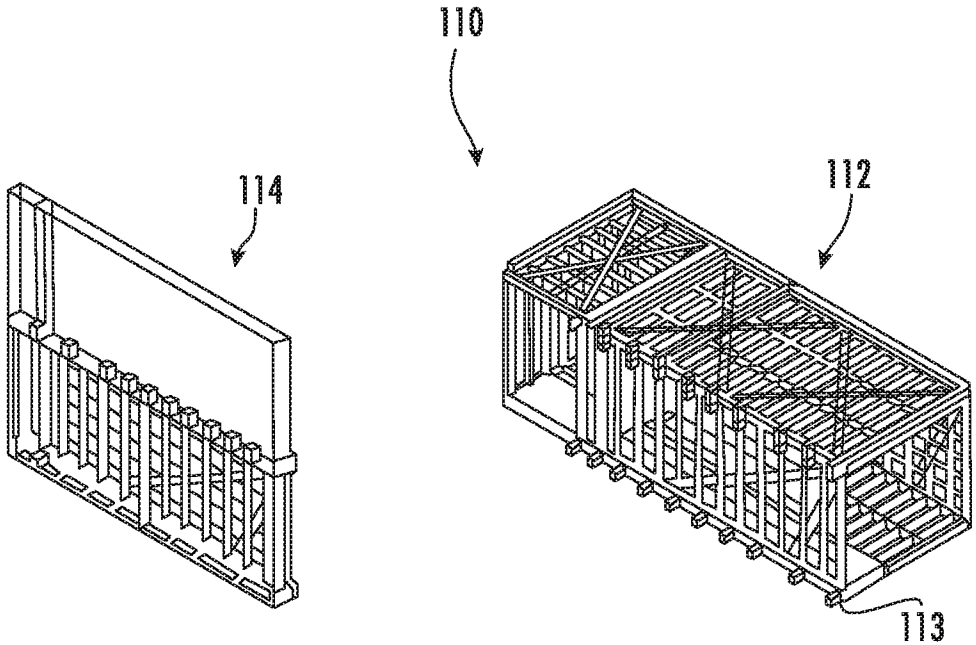
FIG. 2A is a perspective view of another embodiment of a modular assembly including a modular frame and formwork shown disassembled from one another.

With brief reference to FIGS. 2A and 2B, illustrated is another embodiment of a modular assembly 110 having formwork 114 coupled to a long side 113 of the modular frame 112 rather than a short side. In embodiments, discrete formworks may be attached to between two and four sides of the modular frames 12 or 112.

With continued reference to FIGS. 1A and 1B, each of the platforms 16, 18 has a plurality of shafts 20 that project outwardly from outer edges 16*a*, 18*a* of the platforms 16, 18. The shafts 20 are arranged in a linear array along the edges 16*a*, 18*a* of the platforms 16, 18 and facilitate coupling of the formwork 14 to the frame 12, as will be described in greater detail below. In some embodiments, the modular frame 12 may be devoid of the platforms 16, 18, such that the formwork 14 may directly connect to the first side 12*c* of the modular frame 12. The shafts 20 of the platforms 16, 18 extend through openings (not explicitly shown) in a first wall 22*a* of the formwork 14 and into a cavity 30 (FIG. 3) defined between the first wall 22*a* and a second wall 22*b* of the formwork 14.

Figure 3:
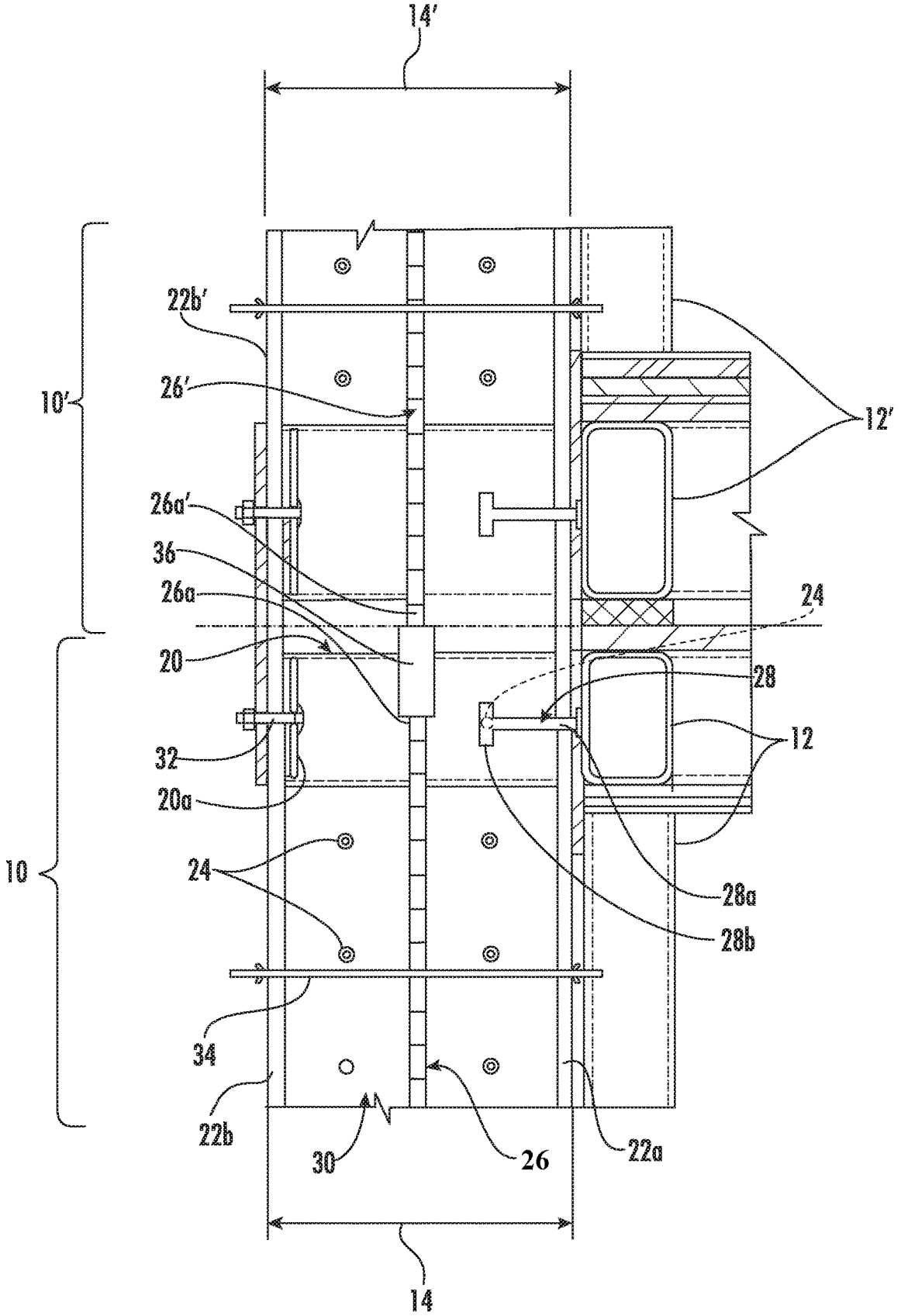
FIG. 3 is an enlarged cross-section, taken alone line 3-3 in FIG. 1B, of stacked modular assemblies.

With additional reference to FIG. 3, the formwork 14 of the modular assembly 10 is coupled to the modular frame 12 and may extend the height of the modular frame 12. In the embodiments illustrated in FIGS. 1A and 2B, the formwork 14 may have a height that is approximately double the height of the modular frame 12 so that when modular assemblies 10, 10' (FIG. 1B) are stacked vertically, only every other modular assembly will require formwork to be affixed thereto. While only one side of the modular frame 12 is shown as having the formwork 14 attached thereto, it is contemplated that discrete formworks may be attached to between two and four sides of the modular frame 12.

The formwork 14 includes a pair of walls 22*a*, 22*b*, a reinforcing bar cage 24, and a vertically-extending reinforcing shaft 26. The first wall 22*a* of the formwork 14 is fixedly connected to the platforms 16, 18 of the modular frame 12 via connectors, such as, for example, fasteners 28. The fasteners 28 may be any suitable fasteners including a rivet, a stud, a bolt, or the like. The fasteners 28 have a first end 28*a* that is fixed (e.g., via welding) to the edges 16*a*, 18*a* of the upper and lower platforms 16, 18 of the modular frame 12. The fasteners 28 extend laterally from the platforms 16, 18, through the first wall 22*a*, and into the cavity 30 defined between the first and second walls 22*a*, 22*b*. A second end 28*b* of each of the fasteners 28 is fixed (e.g., via welding) to the reinforcing bar cage 24. In this way, the fasteners 28 interconnect the modular frame 12 and the formwork 14.

The reinforcing bar cage 24 of the formwork 14 may include a plurality of horizontally-extending reinforcing bars, and a plurality of vertically-extending reinforcing bars that intersect and connect with one another. The cage 24 is received within the cavity 30 of the formwork 14 and provides structural rigidity to the formwork 14 prior to, during, and after formation of the shear wall. Upon fixing the cage 24 to the modular frame 12 (e.g., via the fastener 28), the formwork 14 and the modular frame 12 become a unitary structure. In some embodiments, the modular frame 12 and the formwork 14 may be coupled to one another by securing the modular frame 12 to the first wall 22*a* in addition to or instead of securing the modular frame 12 to the cage 24.

The second wall 22*b* of the formwork 14 is coupled to ends 20*a* of the shafts 20 of the platforms 16, 18 using a fastener, such as, for example, a bolt 32. The second wall 22*b* may be detachably coupled to the ends 20*a* of the shafts 20 so that after formation of the shear wall, the second wall 22*b* may be detached from the modular assembly 10 and be reused. The first and second walls 22*a*, 22*b* may be detachably connected to one another using, for example, formwork ties 34 that span across the cavity 30 of the formwork 14.

The formwork 14 may further include a reinforcing bar or shaft 26 fabricated from metal, such as, for example, steel. The reinforcing shaft 26 is disposed within the cavity 30 and extends along a central, vertical axis of the formwork 14. The reinforcing shaft 26 has a top end 26*a* configured to be coupled to a bottom end 26*a'* of a reinforcing shaft 26' of a modular assembly 10' (FIGS. 1B and 3) stacked on top of the modular assembly 10. For example, the top end 26*a* of the reinforcing bar 26 may have a threaded coupler 36 rotatably coupled and axially fixed thereto. The threaded coupler 36 is dimensioned to threadedly receive the bottom end 26*a'* of the reinforcing shaft 26' of the other modular assembly 10'. Upon receiving the bottom end **26*a*' of the other reinforcing shaft 26', the threaded coupler 36 is rotated about the reinforcing shaft 26 to interconnect the two reinforcing shafts 26, 26', thereby securing the vertically stacked formworks 14, 14'** to one another.

With reference to FIGS. 1B and 3, a method of constructing a shear wall of a modular building using the modular assemblies 10, 10' described above will now be described. A suitable number of modular assemblies are fabricated at an off-site facility and then delivered to the construction site as integral units consisting of the modular frame 12 and formwork 14. While the below description of the fabrication of the shear wall involves the use of only two modular assemblies 10, 10', it is contemplated that the shear wall may be fabricated using more than two modular assemblies.

To manufacture each modular assembly 10, 10', the shafts 20 of the modular frame 12 are positioned through openings (not explicitly shown) in the first wall **22*a* of the formwork 14. The formwork 14 is then coupled to the first side 12*c* of the modular frame 12. In particular, the fasteners 28 are welded to each of the modular frame 12 and the reinforcing bar cage 24 of the formwork 14. Some methods of construction may include fastening the first wall 22*a* of the formwork 14 to the modular frame 12. The second wall 22*b* of the formwork 14 is detachably connected to the ends 20*a* of the shafts 20 and tied to the first wall 22*a* via the ties 34. In other methods, the second wall 22*b* may be delivered to the construction site in a disassembled state from the modular frame 12 and be coupled to the modular frame 12** at the construction site.

At the construction site, the modular assemblies 10, 10' are vertically stacked on top of one another, such that the frame 12' and formwork 14' of the upper modular assembly 10' is disposed on and aligned with the frame 12 and formwork 14 of the lower modular assembly 10, respectively. The formworks 14, 14' together form one continuous cavity 30 through which the reinforcing shafts 26, 26' of the formworks 14, 14' of each of the upper and lower modular assemblies 10, 10' extend. The reinforcing shaft 26' of the upper formwork 14' is received within the threaded coupler 36 of the reinforcing shaft 26 of the lower modular assembly 10, and the threaded coupler 36 is rotated to fixedly secure the reinforcing shafts 26, 26', stabilizing the two modular assemblies 10, 10'.

With the modular assemblies 10, 10' secured to one another, concrete or a similar material is poured into the cavity 30 of the formworks 14, 14'. After allowing the concrete to cure, the second wall **22*b*, 22*b*' of each of the formworks 14, 14' is detached from the respective modular assembly 10, 10', thereby completing the formation of a shear wall, which extends the vertical height of the first and second modular assemblies 10, 10'**.

It will be understood that various modifications may be made to the embodiments and methods disclosed herein. Therefore, the above description should not be construed as limiting, but merely as exemplifications of various embodiments and methods. Those skilled in the art will envision other modifications within the scope and spirit of the claims appended thereto.

What is claimed is:

1. A modular assembly for forming a shear wall, the modular assembly comprising:

a modular frame of a habitable modular unit, the modular frame including a floor and an opposing ceiling and first and second lateral sides interconnecting the floor and ceiling;

formwork including:

a first wall fixedly coupled to the first side of the modular frame; and a second wall spaced from the first wall;

a reinforcing bar cage disposed between the first and second walls; and at least one connector having a first end attached to the first side of the modular frame and a second end directly attached to a portion of the reinforcing bar cage that is between the first and second walls, wherein the modular frame and the formwork are together configured to be stackable with a modular frame and a formwork of another modular assembly, such that a hardening material is pourable into both formworks of the stacked modular assemblies, the second wall being detachably coupled to the first wall, such that the second wall is detached from the first wall after the hardening material is poured into both formworks of the stacked modular assemblies.

2. The modular assembly according to claim 1, wherein the first wall is disposed between the reinforcing bar cage and the first side of the modular frame.

3. The modular assembly according to claim 2, wherein the at least one connector interconnects the modular frame and the formwork.

4. The modular assembly according to claim 3, wherein the at least one connector is a fastener extending laterally from the first side of the modular frame, through the first wall of the formwork, and into a cavity of the formwork.

5. The modular assembly according to claim 1, wherein the first end of the at least one connector is welded to the modular frame, and the second end of the at least one connector is welded to the reinforcing bar cage.

6. The modular assembly according to claim 1, wherein the formwork defines a cavity between the first and second walls, the reinforcing bar cage being disposed within the cavity.

7. The modular assembly according to claim 1, wherein the formwork further includes a reinforcing bar extending vertically within a cavity defined between the first and second walls, the reinforcing bar having an end configured to be coupled to an end of another reinforcing bar of the another modular assembly.

8. The modular assembly according to claim 1, wherein the modular frame includes a plurality of shafts extending laterally from the first side of the modular frame, the second wall configured to be coupled to an end of each of the plurality of shafts.

9. The modular assembly according to claim 8, wherein the plurality of shafts extend horizontally through the cavity.

10. A method of fabricating a modular assembly, comprising:

providing first and second prefabricated modular frames of respective first and second modular assemblies;

fixedly coupling a first wall of a first formwork of the first modular assembly to a first side of the first modular frame;

coupling a reinforcing bar cage of the first formwork to the first side of the first modular frame, such that the first wall is disposed between the reinforcing bar cage and the first modular frame;

coupling a second wall to the first wall;

attaching a first end of at least one connector to the first side of the first modular frame;

directly attaching a second end of the at least one connector to a portion of the reinforcing bar cage that is between the first and second walls;

stacking the second modular frame on a ceiling of the first modular frame, such that a second formwork of the second modular assembly is disposed on top of the first formwork;

pouring concrete into the first and second formworks; and detaching the second wall from the first wall after the concrete is poured into the first and second formworks.

11. The method according to claim 10, wherein the at least one connector is a fastener extending laterally from the first side of the first modular frame, through the first wall of the first formwork, and into a cavity of the first formwork.

12. The method according to claim 10, wherein the reinforcing bar cage is disposed within a cavity defined between the first and second walls.

13. The method according to claim 12, further comprising positioning a reinforcing bar vertically within the cavity, wherein the reinforcing bar has an end configured to be coupled to an end of another reinforcing bar of the second modular assembly.

14. The method according to claim 10, further comprising detachably connecting the second wall to an end of each of a plurality of shafts extending laterally from the first side of the first modular frame.

15. A modular assembly for forming a shear wall, the modular assembly comprising:

a modular frame of a habitable modular unit, the modular frame including a floor and an opposing ceiling and first and second lateral sides interconnecting the floor and ceiling, the modular frame having a first side and a plurality of shafts extending laterally from the first side of the modular frame;

formwork including:

a first wall coupled to the first side of the modular frame; and a second wall spaced from the first wall and configured to be coupled to an end of each of the plurality of shafts; and at least one connector interconnecting the modular frame and the formwork, wherein the modular frame and the formwork are together configured to be stackable with a modular frame and a formwork of another modular assembly, such that a hardening material is pourable into both modular frames of the stacked modular assemblies, the second wall being configured to be detachably coupled to the first wall, such that the second wall is detached from the first wall after the hardening material is poured into both modular frames of the stacked modular assemblies.

16. The modular assembly according to claim 15, further comprising a reinforcing bar cage disposed between the first and second walls.

17. The modular assembly according to claim 16, wherein the at least one connector has a first end attached to the first side of the modular frame and a second end attached to a portion of the reinforcing bar cage that is between the first and second walls.

18. The modular assembly according to claim 15, wherein the at least one connector is a fastener extending laterally from the first side of the modular frame, through the first wall of the formwork, and into a cavity of the formwork.

* * * * *